United States Patent [19]

Suzuki

[11] 3,990,856

[45] Nov. 9, 1976

[54] THERMAL REACTOR WITH SLIDABLE SUPPORT FOR INNER CORE

[75] Inventor: Motoo Suzuki, Kyoto, Japan

[73] Assignee: Mitsubishi Jidosha Kogyo Kabushiki Kaisha, Tokyo, Japan

[22] Filed: June 2, 1975

[21] Appl. No.: 582,711

[30] Foreign Application Priority Data

June 28, 1974 Japan ..... 49-74798

[52] U.S. Cl. ..... 23/277 C; 60/282; 60/322; 60/323; 165/81

[51] Int. Cl.[2] ..... F23G 7/06; F01N 3/10

[58] Field of Search ..... 23/277 C; 60/282, 322, 60/323

[56] References Cited

UNITED STATES PATENTS 3,799,196 3/1974 Scheitlin ..... 60/282 X

*Primary Examiner*—James H. Tayman, Jr.

*Attorney, Agent, or Firm*—Oldham & Oldham Co.

[57] ABSTRACT

A thermal reactor comprising a shell, an outer core in the shell, an inner core supported by the outer core, an inlet pipe being fixed to the shell and extending through the outer and inner cores, and an outlet pipe. A convex portion on the periphery of the outer core is slidably supported in a concave portion provided on the shell and one end of the inner core is slidably supported on the periphery of the outer core. The outlet pipe is fixed to the shell and the outer core. Therefore, relative movements caused by the thermal deformations are permitted between the shell and the outer and inner cores, while generations of noise and vibration of each member are prevented.

6 Claims, 2 Drawing Figures

THERMAL REACTOR WITH SLIDABLE SUPPORT FOR INNER CORE

BACKGROUND OF THE INVENTION

This invention relates to a thermal reactor for treating exhaust gas from an engine of a motor vehicle.

In conventional dual structural thermal reactors, it is necessary to arrange between inner and outer cores and between a shell and said cores such that they are permitted to deform relative to each other due to thermal expansion to prevent their damages. Also, it is necessary to support said cores to prevent production of excessive play therebetween, thereby preventing generations of vibrations and noises.

In order to solve the above technical problems, we have proposed Japanese Pat. Application No. 122728/73 and Japanese U.M. Application No. 133909/72. The former invention relates to a thermal reactor in which one end of the inner core is fixed to one end wall of the outer core and the other end of the inner core is slidably supported on an inner peripheral surface of the other end of the outer core. The latter invention is such that the outer core is formed from two outer core members joined to each other through the flanges integrated therewith, said flanges being supported in a groove provided on an inner periphery of the shell of the thermal reactor with a space so as to permit the thermal expansion of the outer core.

We have made various tests on the thermal reactor in which both of said inventions are combined and in which the inlet pipe fixed to the shell is slidably inserted through said outer and inner cores and the outlet pipe fixed to the outer core is slidably supported in an outlet opening in the shell. As a result, it has been experienced that abnormal wear and unpleasant noise are generated at the sliding portions between the shell and the outer core and between the outlet pipe and the shell because of the vibrations of engine and vibrations generated upon running of the vehicle, since said cores are floatingly suspended within the shell. That is to say, the cores, the shell and the inlet pipe, and the outlet pipe have no fixed portion, which is a based point upon relative movements therebetween due to the thermal expansion. Therefore, the cores are retained in floating conditions within the shell to produce play at sliding portion of each member by vibrations generated during running of the vehicle and operation of the engine, thereby causing vibrations and abnormal noises, and further increasing wear at each sliding portion. Also, it has been experienced that the exhaust gas from the engine enters directly into a space between the outer core and the shell and then is discharged to the atmosphere without reburning of the exhaust gas within the inner core, because after a long period of use play is produced at the sliding portions between the inlet pipe and an inlet portion of the shell and between the outlet pipe and an outlet portion of the shell.

This invention is to provide an improved thermal reactor in which the above drawbacks in the inventions of our aforementioned applications are avoided.

SUMMARY OF THE INVENTION

According to the invention, there is provided a thermal reactor comprising a shell formed from two divided pieces which are joined to each other at circumferential flanges thereof, a tubular outer core slidably held at a convex portion provided on a longitudinal outer periphery of the core within a concave portion provided at the joined portion of the flanges, on a longitudinal inner periphery of the shell, a tubular inner core fixed at one of its longitudinal ends to the corresponding longitudinal end of said outer core, the other longitudinal free end of said inner core being slidably supported longitudinally on an inner circumferential surface at the opposite end of the outer core, at least one inlet pipe passing through said outer core in a fluid tight manner by a seal ring and extending into an interior of the inner core through an opening therein with a sufficient clearance, an outlet pipe fixed at one end to said outer core and at a spaced portion thereof to an outlet open end of said shell, and an adiabatic space defined between said shell and said outer core, an outlet end of said outlet pipe being connected to an exhaust pipe of an engine.

BRIEF DESCRIPTION OF THE DRAWINGS

This invention will be explained by way of example with reference to the accompanying drawings in which.

FIG. I shows a longitudinal transverse cross section of the thermal reactor according to the invention.

DESCRIPTION OF THE PREFERRED EMBODIMENTS

Figure 1:
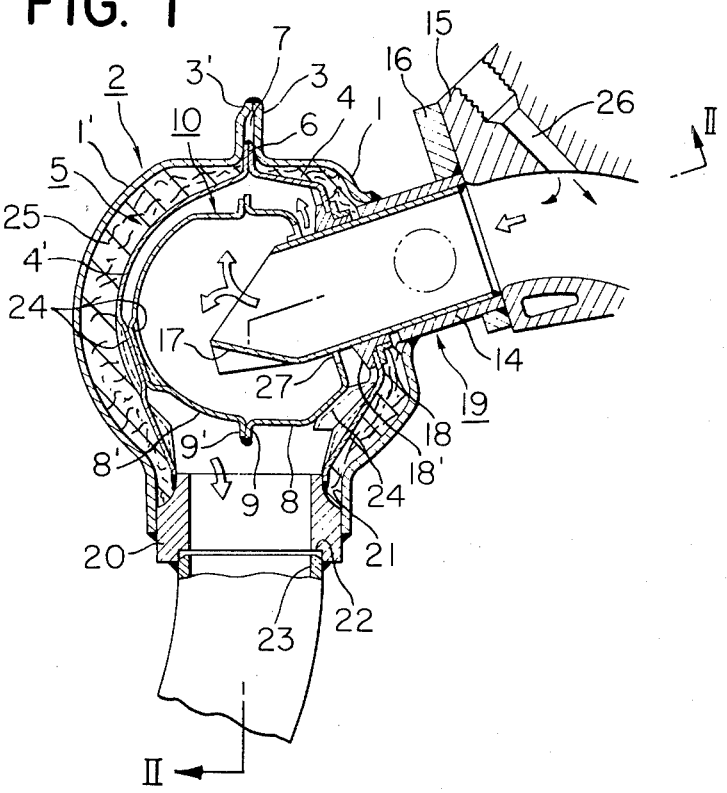
Figure 2:
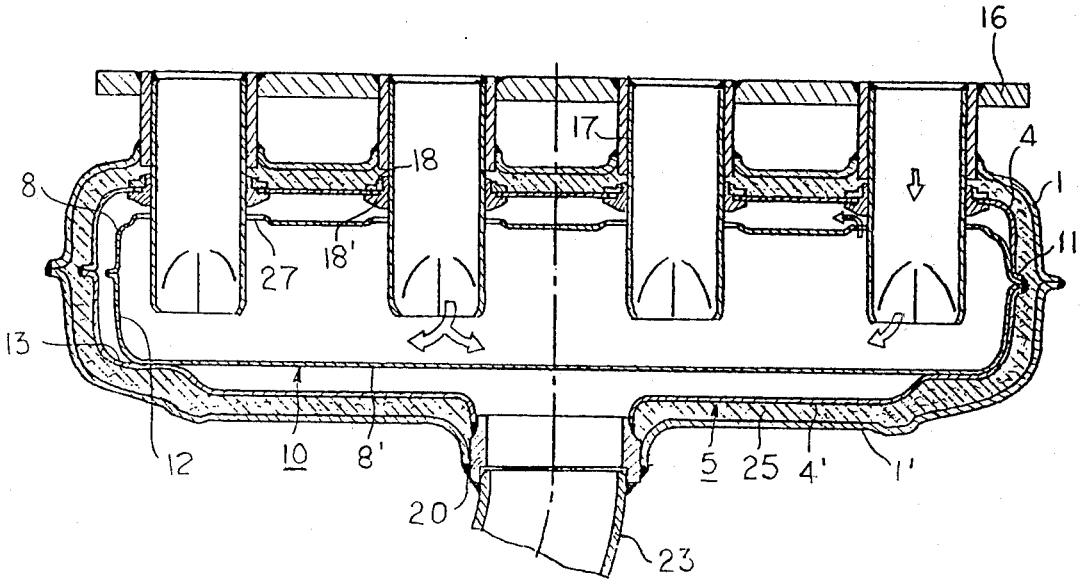
FIG. 2 shows a cross sectional view taken along the line II — II in FIG. 1.

In the drawings, a thermal reactor including a shell 2 formed from two divided shell pieces 1 and 1' which are integrally jointed each other through flanges 3 and 3' by bolts, welding or other suitable means. Similarly, a tubular outer core 5 supported in the shell 2 are formed from two divided outer core pieces 4 and 4' which are joined to each other by for example welding. A convex portion or flange 6 is projecting outwardly from a longitudinal outer periphery of the core 5. The portion 6 is inserted and supported in a concave portion 7 defined between longitudinal inner peripheries of the flanges 3 and 3' of the shell 2 so as to slide in relation to the longitudinal direction. Also, a tubular inner core 10 is formed from two divided inner core pieces 8 and 8' which are joined to each other at their flanges 9 and 9'. One of longitudinal ends of the inner core 10 is secured to the corresponding longitudinal end wall 11 of the outer core 5. The other free end 12 of the inner core 10 opposite to the fixed ends of the cores is slidably supported for longitudinal movement on the inner circumferential surface 13 at the other end of the outer core 5. The thermal reactor has one or more inlet pipes 19 which correspond to the number of cylinders of an engine 15. Each inlet pipe 19 consists of an outer inlet pipe 14 and an inner inlet pipe 17 fixed there to. The inner inlet pipe 14 is fixed at one end to the shell 2 and has a flange 16 on the other end for securing it to the engine 15 by bolts not shown. The inner inlet pipe 17 fixed to the outer inlet pipe 14 passes through the outer core 5 in a fluid tight manner by engaging sealing rings 18 and 18' and extends into the interior of the inner core 10 through an opening 27 therein with clearance between the pipe 17 and the inner core 10.

An outlet pipe 20 is fixed at one end to the outer core 5 and secured at a spaced peripheral portion to an outlet open end 21 of the shell 2 by for example welding. An exhaust pipe 23 of the engine is securely connected to an outlet end 22 of the outlet pipe 20.

Numerals 24 designate supporters which are formed from concave and convex portions or suitable members provided on the peripheries of the outer and inner cores at several locations therebetween. The supporters 24 function to support the cores 5 and 10 so as to slide longitudinally relative to each other while maintaining a given clearance therebetween. An adiabatic material 25 having high heat resistance is filled in an adiabatic space defined between the shell 2 and the outer core 5 according to requirements. Numeral 26 is a secondary air supply port for supplying secondary air which is supplied from an air pump, not shown, and used for causing reburning of the exhaust gas in the thermal reactor.

According to the construction of the above embodiment of this invention, the exhaust gas from the engine 15 enters through the inlet pipe 19 into the inner core 10 and is reburned therewithin by the secondary air from the port 26 to reduce production of hydrocarbon and carbon monoxide. Then, the purified exhaust gas enters into the outer core 5 passing through the sufficient clearance between the inlet pipe 19 and the opening 27 in the inner core 10 and is discharged into the atmosphere through the outlet pipe 20 and the exhaust pipe 23.

When temperature in the inner core 10 rises or drops, the cores 5 and 10 and the shell 2 are thermally expanded or contracted to cause relative movements therebetween. In the thermal reactor according to the invention, the outer core 5 is fixed to the shell 2 through the outlet pipe 20, so that the core 5 can perform extremely stable longitudinal sliding movements about this fixed portion which is a base point for these movements, while the convex portion 6 of the outer core is supported in the concave portion 7 between the flanges 3 and 3' of the shell 2. Also, the free end 12 of the inner core 10 can securely slide on the inner circumferential surface 13 of the outer core 5 notwithstanding vibrations due to vehicle's running, since the inner core 10 is secured at its end to the outer core 5. Furthermore, the radial expansions and contractions of the cores 5 and 10 due to the thermal expansion and contraction are freely permitted relative to the inlet pipe 19 and the cooperating cores, so that the outer and inner cores and the inlet pipe will not be damaged.

As apparent from the above embodiment according to the invention, the outer and inner cores are supported in the shell to permit their expansion and contraction radially and longitudinally relative to the inlet pipe, and are not floated within the shell. The inner inlet pipe 17 is secured at its one end to the outer inlet pipe 14 while its other end is loosely inserted into the inner core 10 to allow expansion and contraction of the inner inlet pipe in a longitudinal direction thereof. Also, the outer core 5 is fixed at one portion to the shell 2 through the outlet pipe 20 and the other portion of the core 5 is supported to permit the sliding movement relative to the shell 2 as described above. Therefore, the outer and inner cores and the inlet and outlet pipes are effectively supported in the shell against vibrations during vehicle's running and permitted their thermal expansions and contractions. Also, generation of play between each member, damages thereof and generation of noises are effectively prevented, because excessive movement of each member is prohibited.

Since generations of large amount of play due to abnormal wear or deformation will not be caused, entrance of the exhaust gas into the space between the outer core 5 and the shell 2 is prevented, so that damage of the adiabatic material 25 due to the exhaust gas will not occur.

Also, the outlet pipe 20 is fixed to the shell 2 near the center of the outer core in a longitudinal direction thereof, thereby preventing the exhaust gas which is not reburned within the inner core from being discharged into the atmosphere. As described above, this invention has specific advantages which cannot be obtained by the conventional thermal reactor.

What is claimed is:

1. An elongated thermal reactor comprising a shell formed from two divided pieces which are joined with each other at circumferential flanges thereof, a tubular outer core slidably held at a convex portion provided on a longitudinally extending outer periphery of the core within a concave portion provided at the joined portion of the flanges on a longitudinally extending inner periphery of the shell, a tubular inner core fixed at one of its longitudinal ends to the corresponding end of said outer core, the other end of said inner core being slidably supported for longitudinal movement on an inner circumferential surface at the opposite end of the outer core, at least one inlet pipe for introducing exhaust gases into said inner core, said inlet pipe consisting of an outer inlet pipe fixed at its one end to the shell and an inner inlet pipe fixed at its one end to said outer inlet pipe, the other end of the inner inlet pipe passing through said outer core in a fluid tight manner by a seal ring and extending into an interior of the inner core through an opening therein with sufficient clearance which allows the exhaust gases to pass from the inner core into a space between said cores and allows for thermal expansion of the inner core, an outlet pipe for discharging the exhaust gases operatively connected at one end to said outer core and at another portion to an outlet open end of said shell and located near a center of the outer core in a longitudinal direction thereof, and a space being defined between said shell and said outer core, said space between the shell and the outer core being filled with an adiabatic material having high heat resistance, an outlet end of said outlet pipe being connected to an exhaust pipe of an engine.

2. A thermal reactor according to claim 1 wherein said sealing ring is slidably mounted on the periphery of said inner inlet pipe to allow for thermal expansion of said outer core and said inner core has closed ends.

3. A thermal reactor according to claim 2 wherein said sealing ring comprising a first sealing member slidably mounted on said inner inlet pipe and stepped at its outer periphery to provide a larger diameter portion and a smaller diameter portion, and a second sealing member fitted on the smaller diameter portion of the first member, an edge of a portion of the outer core, through which said inner inlet pipe passes, being held between said first and second members.

4. A thermal reactor according to claim 1 wherein each of said outer and inner cores is provided on its periphery with at least one supporter for engaging the other core and permitting the relative movement of the cores while maintaining a given clearance therebetween.

5. A thermal reactor according to claim 1 wherein said convex portion of the outer core is formed by a joined portion of flanges of two divided pieces of the outer core, said inner core is formed from two divided pieces by joining flanges thereof, the joined portions of the shell and the outer and inner cores being substantially in the same plane.

6. A thermal reactor according to claim 3, wherein it is provided a plurality of inlet pipes, and inlet pipes being located longitudinally of the shell.

* * * * *